US006941789B2

(12) United States Patent
Nishihara

(10) Patent No.: US 6,941,789 B2
(45) Date of Patent: Sep. 13, 2005

(54) DIE CUSHION DEVICE

(75) Inventor: Yoshitaka Nishihara, Mikuni (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/059,190

(22) Filed: Jan. 31, 2002

(65) Prior Publication Data

US 2002/0104362 A1 Aug. 8, 2002

(30) Foreign Application Priority Data

Feb. 2, 2001 (JP) ..... 2001-027318

(51) Int. Cl.[7] ..... B01D 24/14

(52) U.S. Cl. ..... 72/351; 72/453.13; 267/119

(58) Field of Search ..... 267/119, 127; 72/351, 453.13; 100/269.14, 269.16

(56) References Cited

U.S. PATENT DOCUMENTS 1,503,105 A * 7/1924 Balcker ..... 267/119
1,550,626 A * 8/1925 Nelson ..... 72/351
1,670,552 A * 5/1928 Rode ..... 267/119
1,745,549 A * 2/1930 Marghitan ..... 267/119
1,849,691 A * 3/1932 Rode ..... 267/119
2,827,765 A * 3/1958 Towler ..... 60/328
3,016,005 A * 1/1962 Tomka et al. ..... 100/48
4,056,965 A * 11/1977 Heiser ..... 72/351
4,821,552 A * 4/1989 Baur et al. ..... 72/351
5,100,113 A * 3/1992 Imanishi ..... 267/119
5,138,857 A * 8/1992 Siegert ..... 72/351
5,823,104 A * 10/1998 Beisel et al. ..... 100/48

FOREIGN PATENT DOCUMENTS

JP 53249160 6/1978
JP 62109817 7/1987

* cited by examiner

*Primary Examiner*—Lowell A. Larson
(74) *Attorney, Agent, or Firm*—Vardnell & Varndell, PLLC

(57) ABSTRACT

After molding is started, a large reaction force is obtained by compressing the air within a lower chamber by a piston while maintained in a sealing state. At an intermediate time of the molding, a small reaction force is obtained by communicating the upper and lower chambers with each other by a switching portion of a spool. At a final time of the molding, a large reaction force is again obtained by interrupting a flow path between the upper and lower chambers. The die cushion ability can be mechanically switched in association with the stroke of the piston, the die cushion device can be set such that no time lag is easily caused at a switching time, and the die cushion ability can be instantly switched.

14 Claims, 11 Drawing Sheets

DIE CUSHION DEVICE

BACKGROUND OF THE INVENTION

The present invention relates to a die cushion device, e.g., a die cushion device preferably used in deep drawing molding using a press.

In a press working field of a sheet metal, etc., a die cushion device is conventionally arranged below or within a bed of a press machine, and upward reaction force is applied to a lower die by air pressure, etc. so as to preferably perform the press working.

In the main current of a structure of such a die cushion device, the air within a cylinder set to a predetermined pressure is compressed by lowering a piston, and reaction force caused at that time is utilized.

In accordance with Japanese Utility Model Publication No. 24916/1978 and Japanese Utility Model Laid-Open No. 109817/1987, it is proposed that a plurality of such cylinders are arranged in series, and pistons lowered within the respective cylinders are connected to each other, and a supply source of the compressed air and an air chamber within each cylinder compressed by the piston are communicated with each other through an electromagnetic valve.

In the die cushion device described in each of these official gazettes, for example, smallest die cushion ability can be realized by selectively opening and closing the electromagnetic valve if the compressed air is supplied to only one air chamber, and largest die cushion ability can be realized if the compressed air is supplied to all the air chambers. Thus, the die cushionability can be changed by selectively opening and closing the electromagnetic valve Further, the latter official gazette discloses that the compressed air is also supplied by switching the electromagnetic valve to the air chamber on an upper side increased in volume by lowering the piston, and a pressure receiving face of this piston facing the interior of the air chamber on the upper side is set to have an area smaller than that of a pressure receiving face of this piston facing the air chamber on a lower side.

In such a construction, large die cushion ability can be realized by supplying the compressed air to only the air chamber on the lower side, and small die cushion ability according to the difference in area between the pressure receiving faces can be realized by supplying the air pressure to both the upper and lower air chambers. Therefore, the die cushion ability can be changed even when one cylinder and one piston are used.

In the case of deep drawing molding of a thin plate material, etc., it has been found that it is a useful processing method for improving the quality of molding parts to change a holding degree of the thin plate material in a blank holder by changing the die cushion ability during one stroke as follows.

That is, at an initial stage at which an upper die begins to press the thin plate material, reaction force in the die cushion device is increased so as to firmly hold the thin plate material. At a molding stage from the start of the drawing, the reaction force is reduced so as to preferably perform the drawing. At a final stage at which the molding is terminated, the reaction force is again increased so as to reliably mold an outer shape.

However, in the conventional die cushion device, the die cushion ability is the same as long as the same part is molded if the die cushion ability is once set at a planning time of the press machine. Accordingly, in the conventional die cushion device, a problem exists in that it is impossible to cope with the above-mentioned processing method for changing the die cushion ability during one stroke (during one cycle of the piston of the die cushion device) at a molding time.

Further, the die cushion ability was changed on trial during one stroke by switching the opening and closing of the electromagnetic valve of the conventional die cushion device during one stroke. However, a problem exists in that responsiveness of the electromagnetic valve is bad and no die cushion ability can be smoothly changed.

SUMMARY OF THE INVENTION

An object of the present invention is to provide a die cushion device able to smoothly change die cushion ability during one stroke at a molding time.

In a mode of the invention for achieving this object, a die cushion device comprises first and second chambers arranged within a cylinder and divided by a piston slid within the cylinder and is characterized in that control means for controlling inflow and outflow of a fluid between the first and second chambers in association with a stroke of the piston is provided.

In accordance with this die cushion device, the inflow and outflow of the fluid between the first and second chambers are controlled by the control means between strokes of the piston, i.e., during one stroke at a molding time. In this case, when die cushion ability is reduced, the flow path between the first and second chambers is communicated by the control means, and the piston is moved while fluid pressures of the first and second chambers are maintained at an equal pressure. In contrast to this, when the die cushion ability is increased, the flow path between the first and second chambers is interrupted so as to reliably generate reaction force required in the molding by a compressing action within the second chamber.

Since the control means mechanically controls the inflow and outflow of the fluid between the first and second chambers in association with the stroke of the piston, movements of the fluid at communicating and interrupting times of the flow path between the first and second chambers are rapidly switched so that the die cushion ability can be smoothly changed.

In this die cushion device, the control means is desirably constructed by including a valve body arranged within the cylinder.

Since the control means constructed by the valve body is arranged within the cylinder by this construction, compactness of the die cushion device is promoted.

In this die cushion device, the control means is desirably constructed by including a switching device arranged outside the cylinder.

In accordance with this construction, since the control means is constructed by the switching device arranged outside the cylinder, no switching device is easily limited in structure, size, etc. so that the degree of freedom on design is increased.

In this die cushion device, it is desirable that the piston is slid by a rod, and pressure exhaust means for exhausting a fluid pressure within the first chamber on this rod side is arranged.

In accordance with this structure, there is a case in which the piston compresses the fluid within the first chamber at a completing stage (a returning stage of the piston to a stroke end on a rod side) of one cycle of the piston.

In such a case, when the compressed fluid exists within the first chamber, there is a possibility that no piston is perfectly returned to a correct position. Therefore, in the construction of the invention, the fluid pressure due to such a fluid is exhausted by the pressure exhaust means so that the piston can be reliably returned to the correct position.

Furthermore, a plurality of the control means may be also arranged in the die cushion device of the invention.

In accordance with this construction, the fluid is stepwise moved by the plural control means. If this construction is used in the die cushion device of a multistage type having cylinders and pistons according to the number of control means, it is also possible to provide a die cushion device having larger reaction force, i.e., larger die cushion ability.

DESCRIPTION OF THE PREFERRED EMBODIMENTS

Each embodiment mode of the present invention will next be explained on the basis of the drawings.

A first embodiment mode will first be explained.

Figure 1:
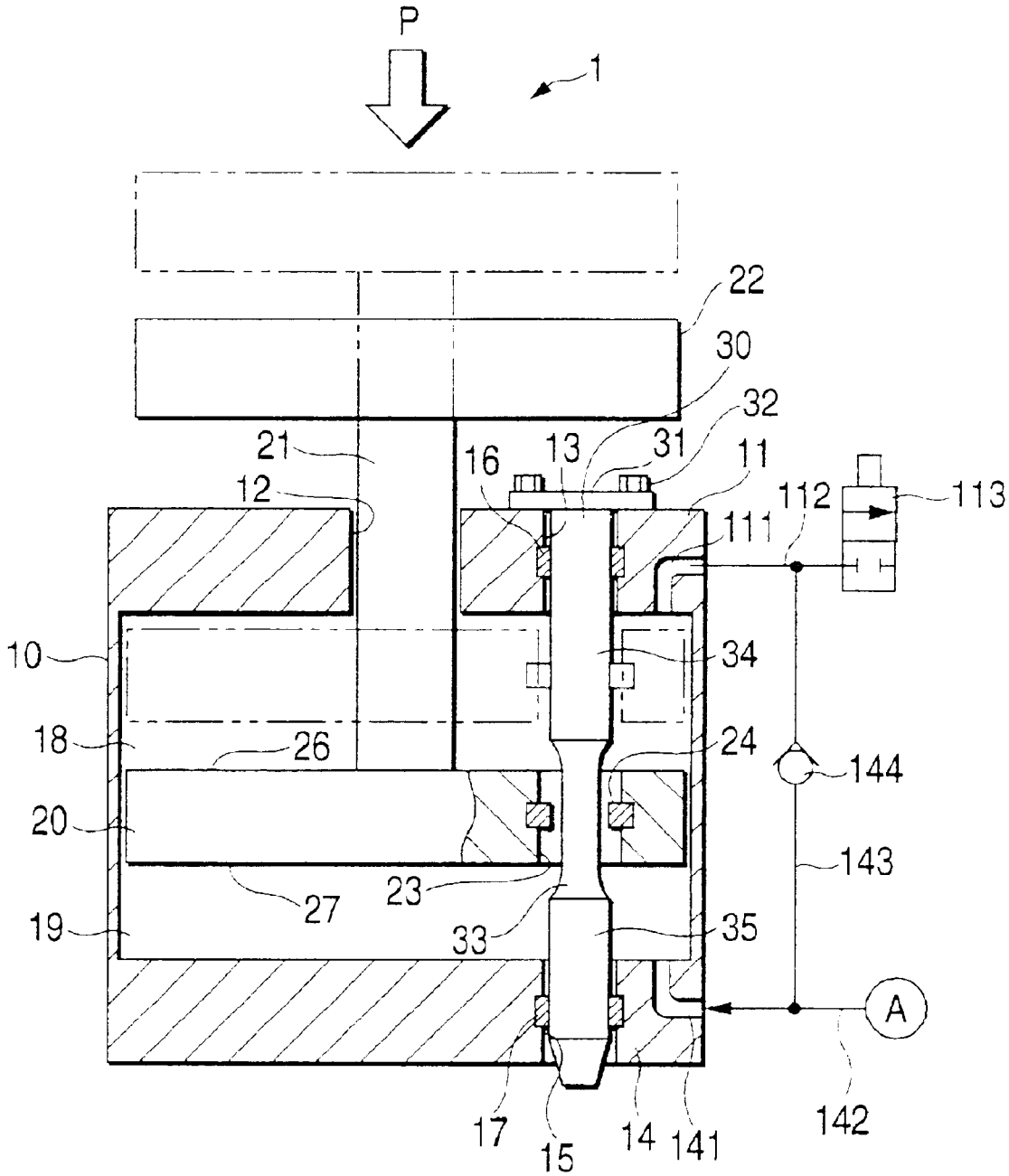
FIG. 1 is a sectional view showing a die cushion device in accordance with a first embodiment mode of the present invention.

FIG. 1 is a sectional view showing a die cushion device 1 in accordance with a first embodiment mode of the present invention. FIG. 2(A), FIG. 2(B), and FIG. 2(C) are views for explaining the operation of a control means constructed by a valve body in the die cushion device 1. FIG. 3 is a time chart showing a generating situation of upward reaction force F against external force P (FIG. 1) applied to the die cushion device 1.

In FIG. 1, the die cushion device 1 is of a pneumatic type having a cylinder 10 of a cylindrical shape having a bottom, a disk-shaped piston 20 slid in a vertical direction in FIG. 1 within the cylinder 10, and a spool 30 extending through the cylinder 10 and the piston 20.

An insertion hole 12 inserting a rod 21 of the piston 20 thereinto, and an insertion hole 13 for inserting the spool 30 thereinto are arranged in an upper face portion 11 of the cylinder 10. An insertion hole 15 for inserting the spool 30 thereinto is also arranged in a bottom face portion 14.

Sealants 16, 17 coming in close contact with the spool 30 and securing inside and outside airtight properties of the cylinder 10 are arranged in the insertion holes 13, 15.

An upper chamber 18 as a first chamber is formed above the piston 20 within the cylinder 10, and a lower chamber 19 as a second chamber is formed below the piston 20.

Similar sealants are also arranged around the insertion hole 12 and the piston 20 although these sealants are omitted in FIG. 1. The inside and outside seal properties of the cylinder 10 and the airtight property between the upper chamber 18 and the lower chamber 19 are secured by these sealants.

First, an air intake port 141 communicated with the lower chamber 19 is arranged on a side of the bottom face portion 14, and a flow path 142 is connected to this air intake port 141. Compressed air is flowed into the lower chamber 19 through this flow path 142 and the air intake port 141 so that the interior of the lower chamber 19 is filled with the compressed air.

In contrast to this, an exhaust port 111 is arranged in the upper face portion 11, and an electromagnetic valve 113 is arranged in the exhaust port 111 through a flow path 112.

A bypass flow path 143 is arranged between the flow paths 112 and 142, and a check valve 144 as an exhaust pressure means is arranged in the bypass flow path 143. The check valve 144 is opened when the air pressure within the upper chamber 18 is equal to or greater than the air pressure within the lower chamber 19. Thus, the check valve 144 has a function for maintaining the interior of each of the chambers 18, 19 at an air pressure A.

A die cushion pad 22 is attached to an upper portion of the rod 21 of the piston 20, and downward external force P is applied to this die cushion pad 22 by the movement of a slide of an unillustrated press machine.

Further, a communication hole 23 is vertically communicated in the piston 20, and a spool 30 extends through the interior of the communication hole 23. A sealant 24 for performing sealing between the communication hole 23 and the spool 30 is arranged in the communication hole 23.

A pressure receiving area of an upper face 26 of the piston 20 facing the upper chamber 18 is smaller by a sectional area of the rod 21 than the pressure receiving area of a lower face 27 of the piston 20 facing the lower chamber 19. Therefore, when no external pressure P is applied and both the pressures within the upper and lower chambers 18, 19 are maintained at the air pressure A, force for raising the piston 20 becomes larger than force for lowering the piston 20 so that the piston 20 is automatically raised.

A flange 31 is arranged at an upper end of the spool 30, and the spool 30 is detachably fixed to the upper face portion 11 of the cylinder 10 by a bolt 32 inserted into this flange 31.

A switching portion 33 having a diameter smaller than the diameters of other portions is arranged at a predetermined length in an intermediate portion of the spool 30 in its vertical direction. The flow path between the upper and lower chambers 18, 19 is communicated when the insertion hole 23 of the piston 20 reaches a position of the switching portion 33. An upper side of the switching portion 33 is set to an upper large diameter portion 34, and a lower side of the switching portion 33 is set to a lower large diameter portion 35. The flow path between the upper and lower chambers 18, 19 is interrupted when the communication hole 23 reaches positions of the upper and lower large diameter portions 34, 35.

That is, in this embodiment mode, the valve body as the control means in the invention is constructed by the piston 20 having the communication hole 23, and the spool 30 having the switching portion 33 and the upper and lower large diameter portions 34, 35.

A diameter, a length and a position of the switching portion 33, the shapes of R-portions on upper and lower end sides of the switching portion 33, etc. are optionally determined in consideration of damping timing of the required reaction force F, a time for damping the reaction force F, power in damping and generating the reaction force F, etc.

An operation of the die cushion device 1 and a change in the reaction force F caused by a stroke of the piston 20 will next be explained with reference to FIGS. 2(A), 2(B), 2(C), and 3.

Figure 2:
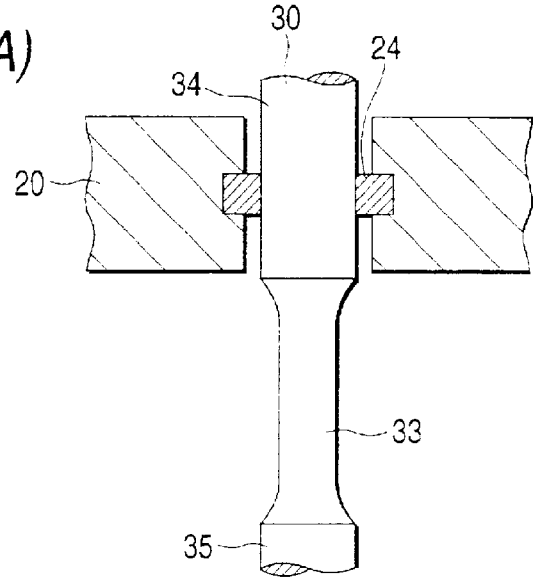
FIG. 2(A), FIG. 2(B), and FIG. 2(C) are views for explaining the operation of a control means constructed by a valve body in the die cushion device of the first embodiment mode.
Figure 2:
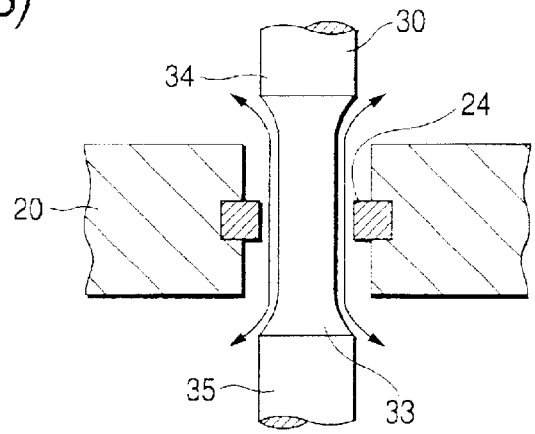
Figure 2:
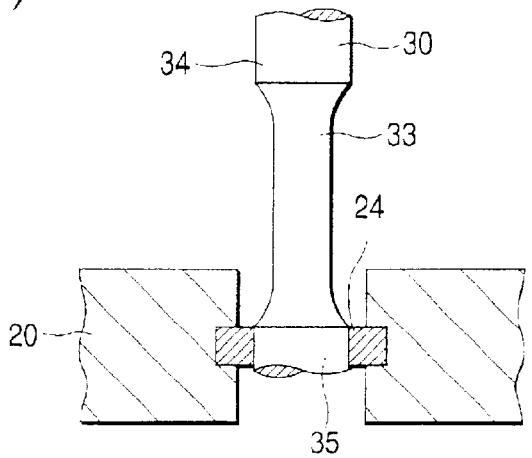
Figure 3:
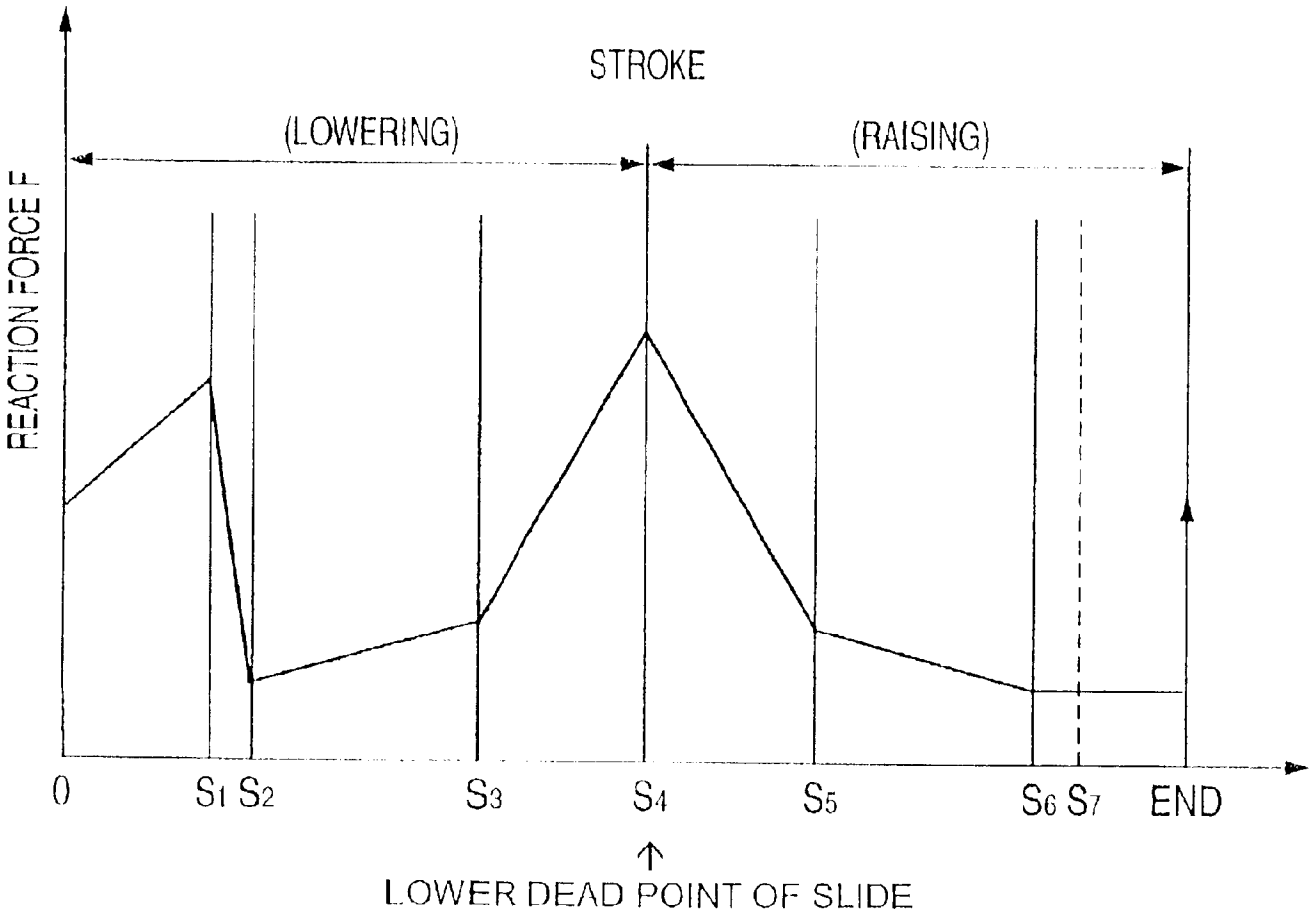
FIG. 3 is a time chart showing a generating situation of upward reaction force against external force applied to the die cushion device of the first embodiment mode.

FIG. 2 (A): First, compressed air is supplied into the lower chamber 19 in advance in a state (illustrated by a two-dotted chain line in FIG. 1) in which the piston 20 is located in an uppermost portion within the cylinder 10. In this state, a thin plate material begins to be molded, and downward external force P is applied onto the die cushion pad 22.

Thus, the piston 20 is lowered and the air within the lower chamber 19 is compressed so that reaction force F opposed to the external force P is caused. The reaction force F is raised as the piston 20 is lowered. The upper chamber 18 above the piston 20 becomes a low pressure (points 0 to S1 in FIG. 3).

FIG. 2(B): Next, when the piston 20 is continuously lowered, the communication hole 23 of the piston 20 reaches the switching portion 33 of the spool 30. When the piston 20 then reaches a perfect releasing position of close contact of the upper large diameter portion 34 of the spool 30 and the sealant 24, the upper and lower chambers 18, 19 are communicated with each other, and one portion of the air compressed within the lower chamber 19 is instantly moved from the communication hole 23 to the upper chamber 18 so that both the interiors of the upper and lower chambers 18, 19 are switched to the air pressure A. In this case, the reaction force F is also instantly damped (S1 to S2 in FIG. 3).

Thereafter, while the air pressure A within the upper and lower chambers 18, 19 are slightly raised, the piston 20 is continuously lowered. The reaction force F in the mean time includes upward force due to the difference in pressure receiving are a between the upper face 26 and the lower face 27 of the piston 20, and also includes force according to a raising amount of the air pressure caused by slightly compressing the air of the lower chamber 19 by fluid resistance caused when the air is moved from the lower chamber 19 to the upper chamber 18. However, this change in the reaction force F is restrained to a small value (S2 to S3 in FIG. 3).

FIG. 2 (C): When the piston 20 is continuously lowered, the sealant 24 of the communication hole 23 gradually passes through the switching portion 33 and comes in close contact with an outer circumference of the lower large diameter portion 35 of the spool 30 so that the flow path between the upper and lower chambers 18, 19 is interrupted. The lower chamber 19 begins to be compressed from this stage, and the reaction force F is again raised greatly (S3 to S4 in FIG. 3).

Subsequently, when the slide of the press machine is lowered to a lowermost point and is reversely raised, the pressure within the lower chamber 19 begins to be returned to the air pressure A from the compression state. Therefore, the piston 20 is pushed up to a position prior to the compression so that volume of the lower chamber 19 is increased and volume of the upper chamber 18 is reduced (S4 to S5 in FIG. 3).

Then, both the pressures within the upper and lower chambers 18, 19 approximately equally approach the air pressure, but the piston 20 is automatically continuously raised by the above difference in the pressure receiving area. Thereafter, when the sealant 24 reaches the switching portion 33 of the spool 30, the air is moved from the upper chamber 18 to the lower chamber 19, and the piston 20 is raised while the interiors of the upper and lower chambers 18, 19 are maintained at the air pressure A (S5 to S6 of FIG. 3).

Thereafter, while the piston 20 is raised, the sealant 24 of the communication hole 23 passes through the switching portion 33 of the spool 30. When the sealant 24 comes in close contact with an outer circumference of the upper large diameter portion 34 of the spool 30, the piston 20 begins to compress the interior of the upper chamber 18. However, the check valve 144 is opened simultaneously when the pressure within the upper chamber 18 is raised by this compression. Therefore, the upper and lower chambers 18, 19 are communicated with each other, and their chamber interiors are maintained at the air pressure A. Therefore, the piston 20 is returned until a position shown by a two-dotted chain line in FIG. 1, i.e., a starting position of the stroke in a small state of the reaction force F (S6 to S7 to END in FIG. 3).

As shown by a vertical arrow in an "END" position in FIG. 3, the upper chamber 18 is opened to the atmosphere, etc. by switching positions of the electromagnetic valve 113 so that the compressed air left within the upper chamber 18 can be forcedly discharged and the piston 20 can be returned to the original position.

Further, when no piston 20 is returned until the final position for some reasons, the air within the upper chamber 18 is also discharged by switching the electromagnetic valve 113, and the piston 20 can be forcedly returned to the original position.

In accordance with such an embodiment mode, there are the following effects.

(1) When molding is started and external force P begins to be applied to the die cushion device 1, the piston 20 compresses the air within the lower chamber 19 while a sealing state of the upper and lower chambers 18, 19 is maintained. Accordingly, large reaction force F against this external force P can be generated. When the piston 20 is further continuously lowered, the reaction force F can be reduced by communicating the upper and lower chambers 18, 19 with each other by the switching portion 33 of the spool 30. Thereafter, the air within the lower chamber 19 is again compressed and large reaction force F can be generated by interrupting and closing the flow path between the upper and lower chambers 18, 19.

Thus, in this embodiment mode, die cushion ability (reaction force F) can be switched during one stroke of the piston 20. In particular, the reaction force F is increased at a starting time of the molding, and is reduced at an intermediate time of the molding, and is again increased at a final time of the molding. Thus, a holding degree of the thin plate material using a blank holder, etc. can be changed, and it is possible to preferably cope with the deep drawing molding of the thin plate material.

(2) In this case, the reaction force F is mechanically switched in association with the stroke of the piston 20 by the spool 30 arranged within the cylinder 10 and extending through the piston 20. Therefore, the die cushion device can be set such that no time lag at a switching time is easily caused, and the reaction force F can be instantly switched.

(3) Since the reaction force F is switched by the spool 30 within the cylinder 10, it is not necessary to arrange a complicated mechanism outside the cylinder 10 so that structure can be simplified.

Further, when the reaction force F is changed in separate timing, etc., it is sufficient to set a separate spool instead of the spool 30 so that it is possible to easily cope with another molding.

(4) Since the spool 30 is also used as a guide member of the piston 20 by extending through the piston 20, the piston 20 can be more reliably and smoothly slid in the vertical direction.

(5) The piston 20 is formed in a disk shape and the pressure receiving area of the lower face 27 is larger by the sectional area of the rod 21 than the pressure receiving area of the upper face 26. Therefore, when no external force P is applied and the pressures within the upper and lower chambers 18, 19 are set to the same, the piston 20 can be automatically raised so that no special raising mechanism is required and the structure can be further simplified.

(6) Since the check valve 144 is arranged in the bypass flow path 143 between the flow paths 112 and 142, the check valve 144 can be opened when the air pressure within the upper chamber 18 is equal to or greater than the air pressure within the lower chamber 19. Therefore, when the piston 20 begins to be returned to the original position, the air pressure within the upper chamber 18 can be discharged and escaped to a side of the flow path 142 even when the air within the upper chamber 18 is compressed. Accordingly, the interiors of the upper and lower chambers 18, 19 can be maintained at the air pressure A without substantially compressing the air within the upper chamber 18, and the piston 20 can be reliably raised to the uppermost position.

(7) The electromagnetic valve 113 for forcedly exhausting the air left within the upper chamber 18 is arranged in the cylinder 10. Accordingly, even when the left air becomes resistance and no piston 20 is returned until the uppermost position, the left air can be exhausted by switching the electromagnetic valve 113 so that disadvantages can be rapidly avoided.

A second embodiment mode will next be explained.

Figure 4:
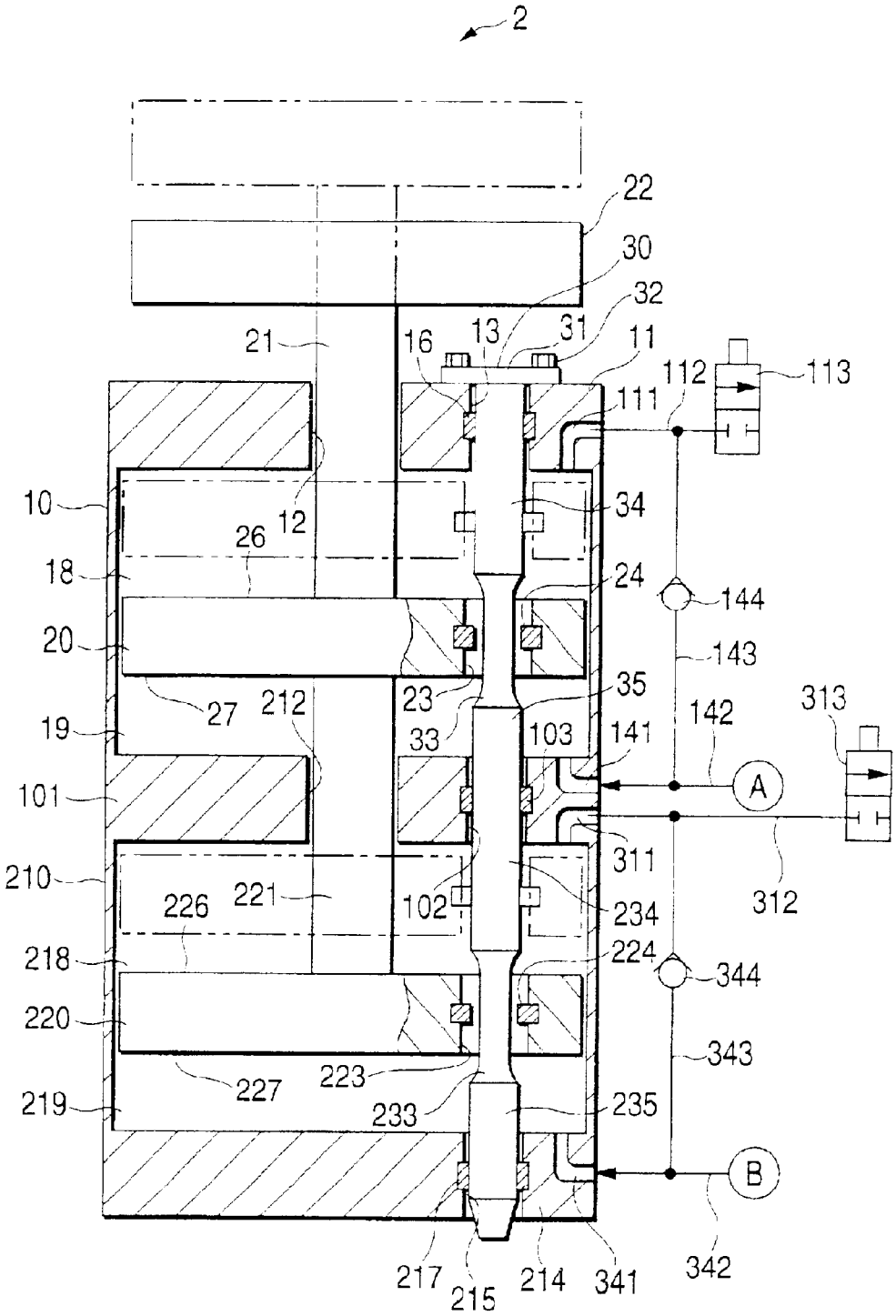
FIG. 4 is a sectional view showing a die cushion device in accordance with a second embodiment mode of the invention.

FIG. 4 shows a sectional view of a die cushion device 2 in accordance with the second embodiment mode of the invention.

In FIG. 4, the same functional members as the first embodiment mode are designated by the same reference numerals, and their detailed explanations are omitted or simplified here. The detailed explanations are similarly omitted or simplified with respect to other embodiment modes and modified examples explained later.

In the die cushion device 2, a separate cylinder 210 is arranged in series and integrally below the cylinder 10. A piston 220 slid within the cylinder 210 is connected to a lower portion of the piston 20 through a rod 221. An upper chamber 218 is formed above the piston 220 within the cylinder 210, and a lower chamber 219 is formed below the piston 220.

An insertion hole 212 inserting the rod 221 of the piston 220 thereinto is arranged in a partition wall portion 101 between the cylinders 10 and 210, and an unillustrated sealant is arranged around the insertion hole 212 and the piston 220. Thus, the airtight property between the lower chamber 19 of the cylinder 10 and the upper chamber 218 of the cylinder 210 is secured. Further, volumes of the cylinders 10, 210 are optionally determined in their operations, but are set to be approximately the same in this embodiment mode.

Similar to the cylinder 10, an exhaust port 311, a flow path 312, an electromagnetic valve 313, an air intake port 341, a flow path 342, a bypass flow path 343 and a check valve 344 are arranged in the cylinder 210.

An insertion hole 102 of a spool 30 is arranged in the partition wall portion 101 between the cylinders 10 and 210, and a sealant 103 is arranged in the insertion hole 102. An insertion hole 215 of the spool 30 is arranged in a bottom face portion 214 of the cylinder 210, and a sealant 217 is arranged in this insertion hole 215.

A communication hole 223 is vertically communicated in the piston 220, and the spool 30 extends through the interior of the communication hole 223. A sealant 224 is arranged in this communication hole 223.

On the other hand, the spool 30 is arranged such that the spool 30 extends through both the pistons 20, 220. The spool 30 has a switching portion 33 located within the cylinder 10, and a separate switching portion 233 located within the cylinder 210. The switching portion 233 has a length shorter than that of the switching portion 33.

An upper large diameter portion 34 is located on an upper side of the switching portion 33, and a lower large diameter portion 35 is located on a lower side of the switching portion 33. An upper large diameter portion 234 continuously connected to the lower large diameter portion 35 is located on an upper side of the switching portion 233, and a lower large diameter portion 235 is located on a lower side of the switching portion 233.

In the above embodiment mode, one control means is constructed by the piston 20 having the communication hole 23, and an upper side portion of the spool 30 having the switching portion 33. Another control means is constructed by the piston 220 having the communication hole 223, and a lower side portion of the spool 30 having the switching portion 233. Accordingly, plural (two in this embodiment mode) control means are arranged.

In such a die cushion device 2 of the present embodiment mode, when the pistons 20, 220 located in uppermost positions within the cylinders 10, 210 are lowered by unillustrated external force P, both the airs within the lower chambers 19, 219 are simultaneously compressed so that unillustrated reaction force F is generated.

When the pistons 20, 220 are further lowered, the communication hole 23 of the piston 20 first reaches the switching portion 33, and the upper and lower chambers 18, 19 begin to be communicated with each other so that the reaction force F is damped. However, at this stage, no communication hole 223 of the piston 220 reaches a position for communicating the lower chambers 218, 219 with each other (a state of FIG. 4) since the length of the switching portion 233 is short. The lower chamber 219 is continuously compressed by the piston 220 as it is.

Since the pistons 20, 220 are further lowered, the upper and lower chambers 218, 219 are also communicated with each other by the communication hole 223 while the communication state between the upper and lower chambers 18, 19 is continued by the communication hole 23. The reaction force F is reduced until a minimum level.

Thereafter, when the pistons 20, 220 are further lowered, the respective sealants 24, 224 of the communication holes 23, 223 simultaneously interrupt the flow path between the upper and lower chambers 18, 19 and the flow path between the upper and lower chambers 218, 219. Thus, the air within each of the lower chambers 19, 219 is compressed so that the reaction force F is again raised.

When the slide is raised, the pistons 20, 220 are automatically raised by the difference in area between upper and lower faces 226, 227. The principle in this case is the same as the first embodiment mode.

In accordance with this embodiment mode, the above effects (1) to (7) can be similarly obtained by a construction similar to that of the first embodiment mode, and the following effects can be also obtained by the peculiar construction having two control means.

(8) That is, in the die cushion device 2, timing for communicating the upper and lower chambers 18, 19 with each other and timing for communicating the upper and lower chambers 218, 219 with each other are shifted from each other during one stroke of each of the pistons 20, 220 by arranging the two switching portions 33, 233 in the spool 30 and setting lengths of these switching portions to be different from each other. Accordingly, magnitude of the reaction force F can be stepwise damped at two stages so that the die cushion device 2 can be set to a multistage type.

(9) Further, since both the lower chambers 19, 219 formed within the two cylinders 10, 210 are compressed by the pistons 20, 220, it is possible to approximately generate double reaction force F in comparison with the die cushion device 1 of the first embodiment mode in which only one lower chamber 19 is compressed. Therefore, die cushion ability can be increased.

A third embodiment mode will next be explained.

Figure 5:
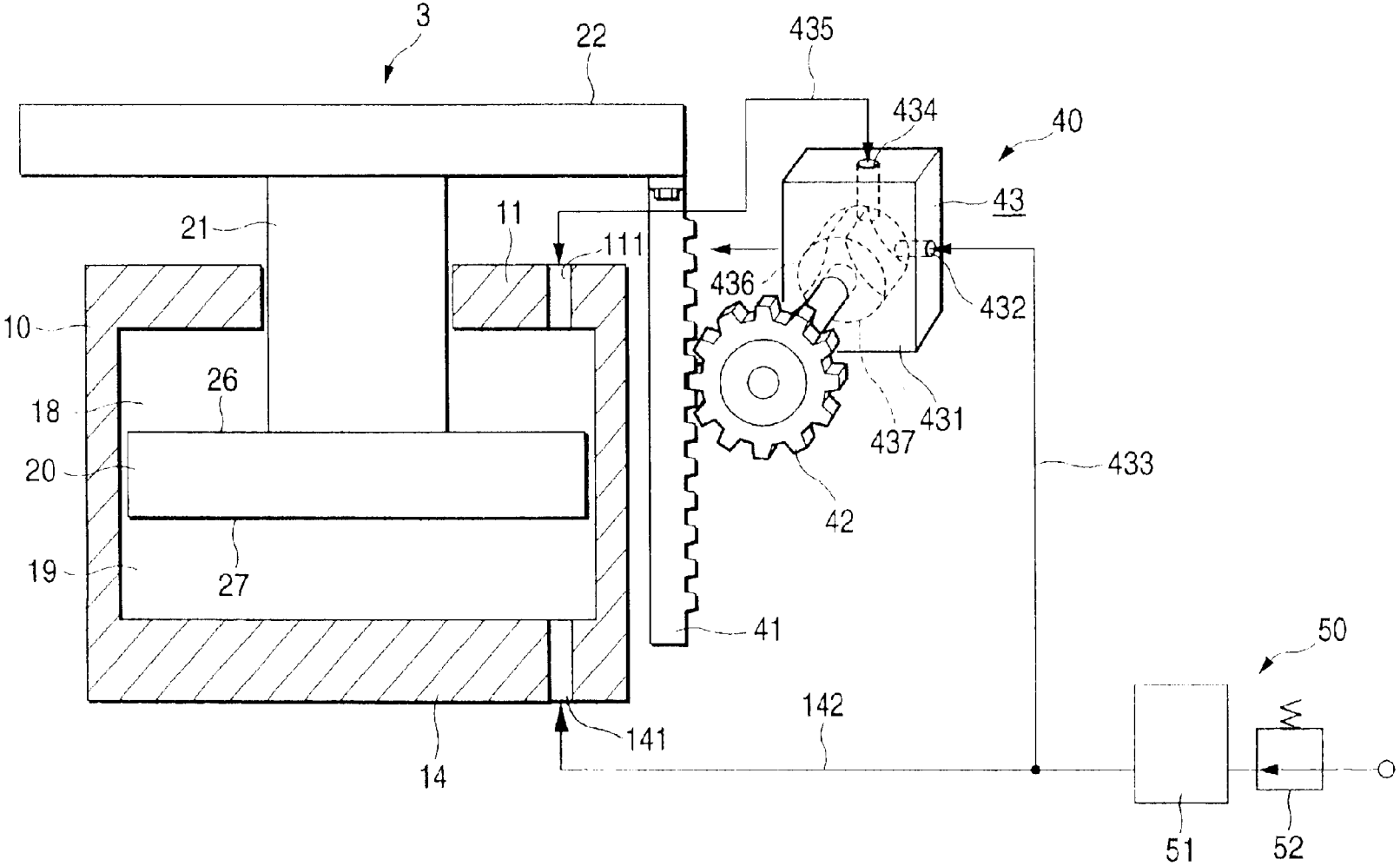
FIG. 5 is a sectional view showing a die cushion device in accordance with a third embodiment mode of the invention.

FIG. 5 shows a die cushion device 3 in accordance with the third embodiment mode of the invention. The illustration of a sealant is omitted in FIG. 5.

The die cushion device 3 greatly differs from the first and second embodiment modes in that a switching device 40 is arranged outside the cylinder 10, and inflow and outflow of the air between the upper and lower chambers 18, 19 are mechanically controlled by a control means constructed by this switching device 40. Accordingly, no spool 30 as in the first and second embodiment modes is arranged in the cylinder 10 of the die cushion device 3, and no communication hole 23, etc. are also arranged in the piston 20.

Reference numeral 50 in FIG. 5 designates a pressure supply source constructed by a tank 51 functioning as e.g., an accumulator, and a pressure reducing valve 52. The pressure supply source 50 supplies compressed air having a predetermined pressure to the lower chamber 19 of the cylinder 10 through a flow path 142.

The switching device 40 has a rack 41 arranged in a die cushion pad 22 and vertically moved together with the piston 20, a rotated pinion gear 42 engaged with the rack 41, and a rotary valve 43 operated by rotating the pinion gear 42.

In the rotary valve 43, a first port 432 formed in a sleeve 431 and a flow path 142 are communicated with each other by a flow path 433, and a second port 434 and the upper chamber 18 are communicated with each other by a flow path 435, and a third port 436 is opened to the atmosphere.

Figure 6:
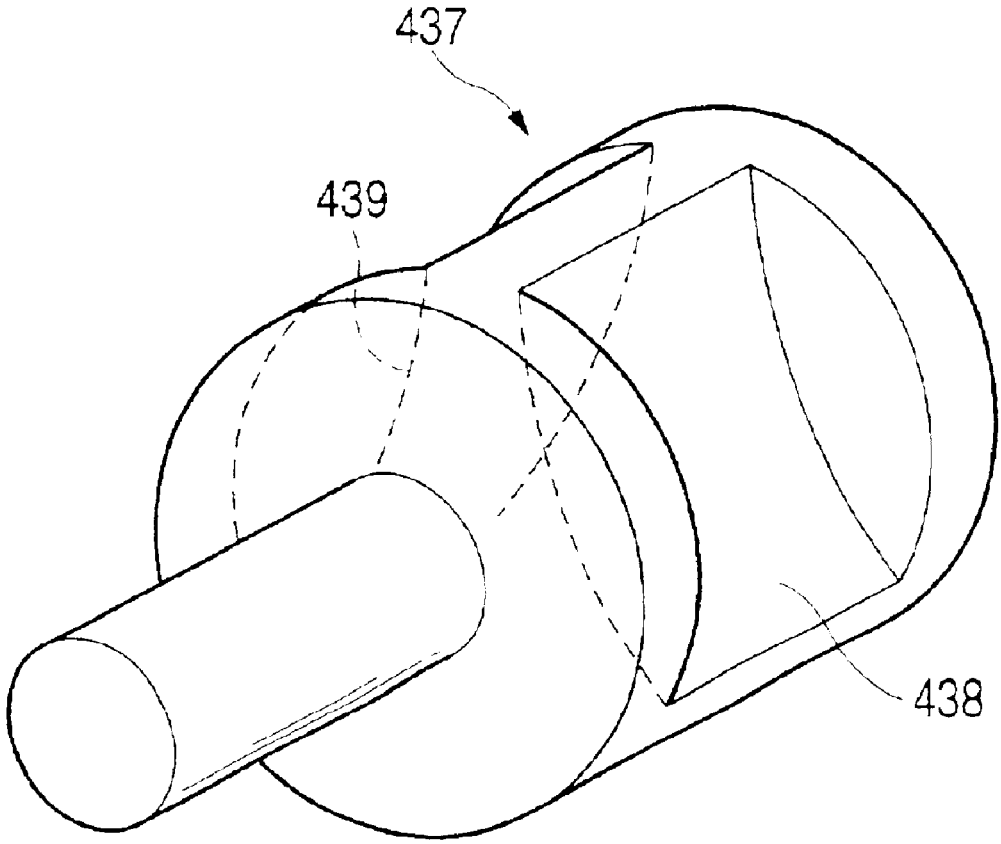
FIG. 6 is a perspective view showing one constructional part of a control means constructed by a rotary valve in the die cushion device of the third embodiment mode.

As enlargedly shown in FIG. 6, a pair of concave switching portions 438, 439 is arranged in a rotor 437 of the rotary valve 43 such that the switching portions 438, 439 are spaced from each other in a circumferential direction. The switching portion 438 has a function for communicating the first and second ports 432, 434 with each other. The switching portion 439 has a function for communicating the second and third ports 434, 436 with each other.

An operation of the die cushion device 3 performed by a stroke of the piston 20 will next be explained on the basis of FIGS. 5, 7(A), 7(B), and 7(C).

Figure 7:
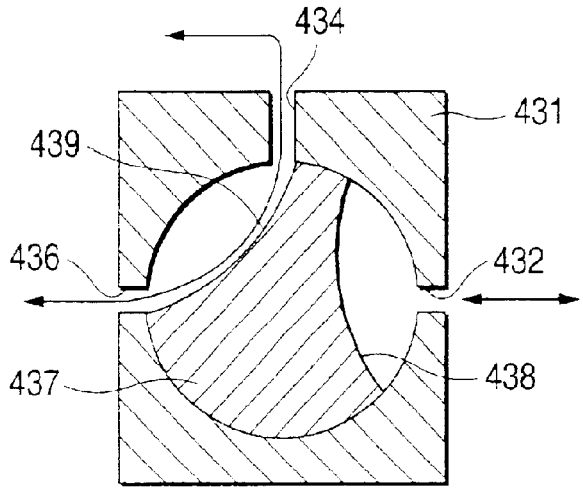
FIG. 7(A), FIG. 7(B), and FIG. 7(C) are views for explaining an operation of the control means constructed by the rotary valve in the die cushion device of the third embodiment mode.
Figure 7:
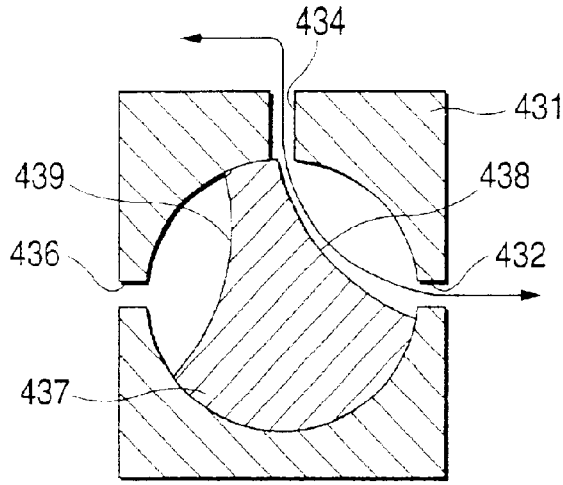
Figure 7:
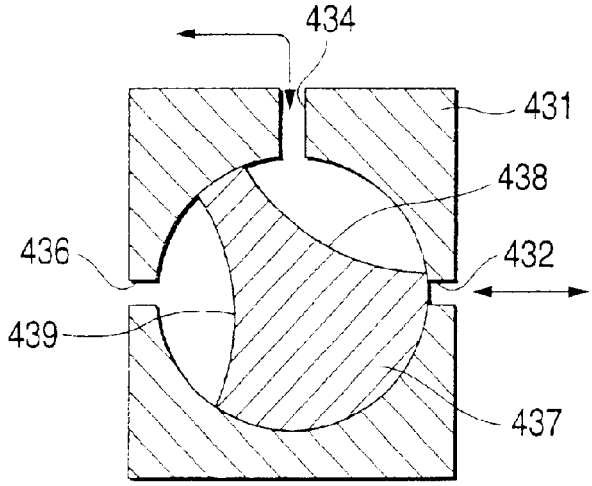

FIG. 7(A): When the piston 20 is located in an uppermost position, the switching portion 438 is located on a side of the first port 432 in the rotor 437 of the rotary valve 43, and the flow path between the upper and lower chambers 18, 19 within the cylinder 10 is interrupted by the rotor 437. Accordingly, when the piston 20 is lowered by unillustrated external force P from this state, the air within the lower chamber 19 is compressed and unillustrated large reaction force F is obtained.

FIG. 7(B): When the rotor 437 is rotated in the counterclockwise direction as the piston 20 is lowered, the first and second ports 432, 434 are gradually communicated with each other by the switching portion 438. Thus, the upper and lower chambers 18, 19 are communicated with each other and the air is moved so that the interiors of these chambers instantly become an equal pressure. In this state, the reaction force F against the external force P is instantly reduced.

FIG. 7(C): When the piston 20 is further lowered and the first port 432 is closed by the rotor 437, the flow path between the upper and lower chambers 18, 19 is interrupted and the air within the lower chamber 19 is compressed so that the reaction force F is again raised. Thereafter, when a slide is raised, the piston 20 is automatically raised and the rotor 437 is rotated in the clockwise direction.

When the piston 20 is returned until a position near the uppermost position, the second and third ports 434, 436 are communicated with each other by the switching portion 439 as shown in FIG. 7(A) so that the air is exhausted from the interior of the upper chamber 18. Thus, the pressure within the upper chamber 18 is exhausted, and the piston 20 is reliably returned to the uppermost position before the piston 20 begins to be lowered. That is, the third port 436 and the switching portion 439 function as a pressure exhaust means in the invention.

In accordance with this embodiment mode, inflow and outflow of the air between the upper and lower chambers 18, 19 can be mechanically controlled in association with the stroke of the piston 20 by arranging the switching device 40. Therefore, the above effects (1) and (2) can be similarly obtained and the object of the invention can be achieved although the construction is different. Further, the above effect (5) can be also obtained by a construction similar to that of each of the first and second embodiment modes. Further, the above effect (6) can be similarly obtained since one portion of the rotary valve 43 functions as the pressure exhaust means.

In addition, there are the following effects by the peculiar construction of this embodiment mode.

(10) Since the switching device 40 for controlling the inflow and outflow of the air between the upper and lower chambers 18, 19 is arranged outside the cylinder 10, the die cushion device 3 can be set such that no switching device 40 is easily restricted in structure, etc., in comparison with a case in which the switching device 40 is arranged within the cylinder 10. Accordingly, cost can be reduced by freely designing the die cushion device to a certain degree.

A fourth embodiment mode will next be explained.

Figure 8:
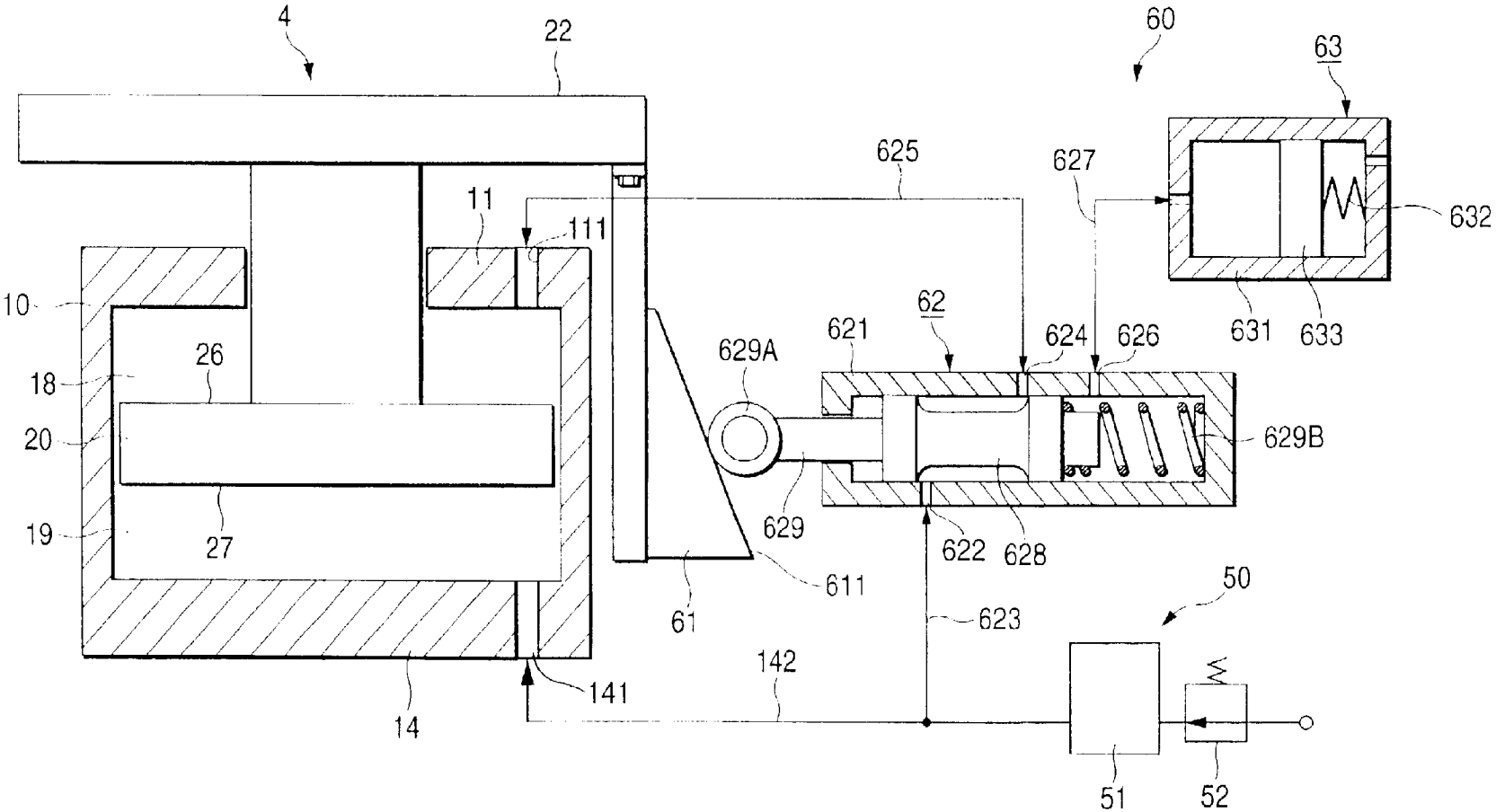
FIG. 8 is a sectional view showing a die cushion device in accordance with a fourth embodiment mode of the invention.

FIG. 8 shows a die cushion device 4 in the fourth embodiment mode of the invention. The illustration of a sealant is also omitted in FIG. 8.

In the die cushion device 4, the construction of a switching device 60 as a control means arranged outside the cylinder 10 greatly differs from that of the switching device 40 of the third embodiment mode. The other constructions are approximately the same as the third embodiment mode.

The switching device 60 has a guide member 61 arranged in a die cushion pad 22 and vertically moved together with this die cushion pad, a spool valve 62 switched in accordance with a vertical position of the guide member 61, and an air reservoir device 63 communicated with the spool valve 62.

A taper face 611 is formed in the guide member 61, and this taper face 611 is linearly inclined so as to be separated from the cylinder 10 as this taper face 611 is directed downward.

A shape of the taper face 611, etc. may be optionally determined in accordance with how to generate an operating speed of the spool valve 62 and unillustrated reaction force F. For example, the operating speed of the spool valve 62 may be increased by increasing an inclination angle. Further, the operation of the spool valve 62 may be substantially stopped and the spool valve 62 may be reversely operated during one stroke by arranging a vertical face in an intermediate portion of the taper face 611, or arranging a taper face reversely inclined in the intermediate portion.

In the spool valve 62, a first port 622 formed in a sleeve 621 and a flow path 142 are communicated with each other by a flow path 623, and a second port 624 and the upper chamber 18 are communicated with each other by a flow path 625, and a third port 626 and the air reservoir device 63 are communicated with each other by a flow path 627.

A spool 628 is stored into the sleeve 621 and is slid within this sleeve 621, and has a switching portion 628A and left-hand and right-hand large diameter portions 628B, 628C. A roller 629A of a rod 629 arranged at one end of this spool 628 is rolled on the taper face 611 of the guide member 61. In this case, the roller 629A is biased so as not to be separated from the taper face 611 at any time by a spring 629B, etc. on the other side of the spool 628.

The air reservoir device 63 stores the air from the upper chamber 18 without exhausting this air into the atmosphere when the pressure within the upper chamber 18 is exhausted. The air reservoir device 63 has a cylinder 631 and a piston 633 biased by a spring 632. One of spaces within the cylinder 631 partitioned by the piston 633 is an air reservoir space of a variable volume type, and the other space storing the spring 632 thereinto is opened to the atmosphere.

The construction of the air reservoir device is not limited to this construction, but, for example, a construction similar to that of a rubber balloon expanded and contracted in accordance with an internal air amount may be also optionally applied.

An operation of the die cushion device 4 performed by the stroke of the piston 20 will next be explained on the basis of FIGS. 8, 9(A), 9(B), and 9(C).

Figure 9:
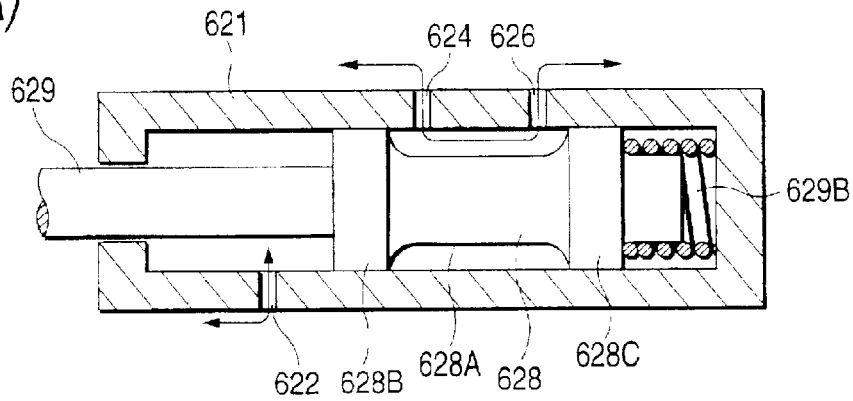
FIGS. 9(A), 9(B), and 9(C) are views for explaining the operation of a control means constructed by a valve body in the die cushion device of the fourth embodiment mode.
Figure 9:
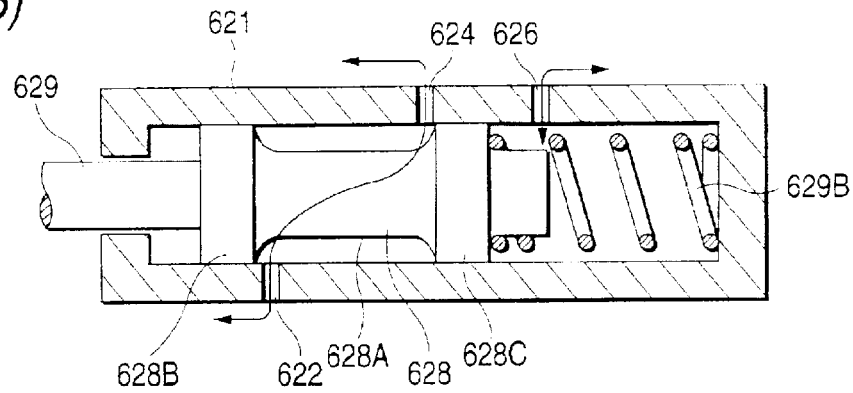
Figure 9:
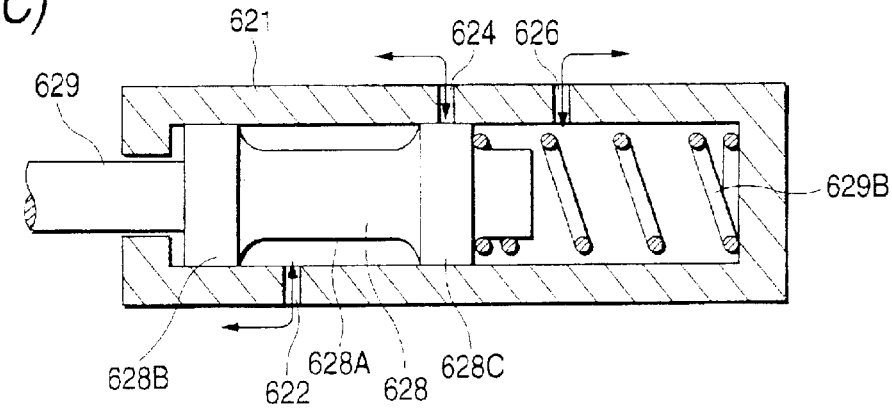

FIG. 9(A): When the piston 20 is located in an uppermost position, the spool 628 of the spool valve 62 is located on sides of the second and third ports 624, 626, and the flow path between the upper and lower chambers 18, 19 within the cylinder 10 is interrupted by the spool 628. Accordingly, when the piston 20 is lowered by unillustrated external force P from this state, the air within the lower chamber 19 is compressed and unillustrated large reaction force F is obtained.

FIG. 9(B): When the roller 629A is rolled on an upper portion side of the taper face 611 as the piston 20 is lowered, the spool 628 is gradually moved onto the left-hand side of this figure. The first and second ports 622, 624 are communicated with each other by the switching portion 628A so that the upper and lower chambers 18, 19 are communicated with each other and the air is moved and the interiors of these chambers instantly become an equal pressure. In this state, similar to the third embodiment mode, the reaction force F against the external force P is instantly reduced.

FIG. 9(C): When the piston 20 is further lowered and the second port 624 is closed by the right-hand large diameter portion 628C of the spool 628, the flow path between the upper and lower chambers 18, 19 is interrupted and the interior of the lower chamber 19 is compressed, and the reaction force F is again raised. Thereafter, when the slide is raised, the piston 20 is automatically raised and the spool 628 is moved onto the right-hand side.

When the piston 20 is returned until a position near the uppermost position, the second and third ports 624, 626 are communicated with each other by the switching portion 628A, and the air within the upper chamber 18 is moved into the air reservoir device 63 as shown in FIG. 8. Thus, the pressure within the upper chamber 18 is exhausted, and the piston 20 is reliably returned to the uppermost position before the piston 20 begins to be lowered. That is, in this embodiment mode, the third port 626 and the switching portion 628A function as the pressure exhaust means in the invention.

In this embodiment mode, effects similar to those in the third embodiment mode can be obtained although the construction of the switching device 60 is different. Further, there are the following effects by the peculiar construction of the switching device 60.

(11) Since the switching device 60 in this embodiment mode has the air reservoir device 63, no air compressed within the upper chamber 18 is exhausted to the atmosphere, etc. so that the operating air can be effectively utilized and unnecessary energy consumption can be restrained.

(12) It is sufficient to change the shape of the taper face 611 of the guide member 61 to set generating degrees of the reaction force F to be different from each other. However, since the guide member 61 is arranged outside the cylinder 10, an exchanging work of another guide member can be easily and rapidly made, and a planning time can be greatly shortened.

The invention is not limited to each of the above embodiment modes, but other constructions able to achieve the object of the invention, etc. are included, and modifications, etc. shown below are also included in the invention.

Figure 10:
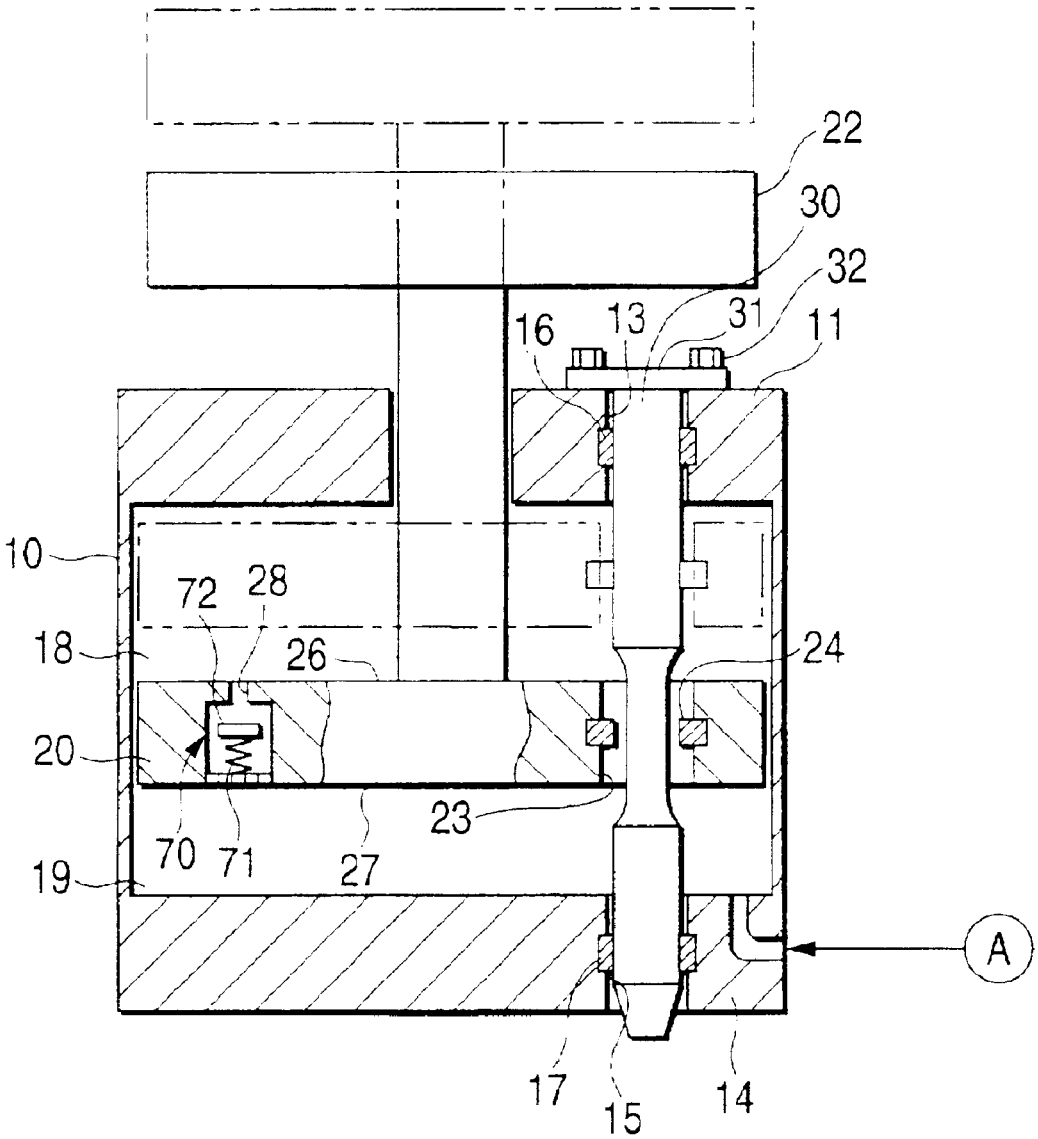
FIG. 10 is a sectional view showing a modified example of the invention.

For example, in the first and second embodiment modes, the check valves 144, 344 arranged outside the cylinder 10 are used as the pressure exhaust means in the invention. However, in addition, as shown in FIG. 10, a check valve 70 arranged in the piston 20 may be also used.

This check valve 70 is attached into a through flow path 18 extending through the piston 20. When the interiors of the upper and lower chambers 18, 19 are set to an equal pressure, or when the pressure within the upper chamber 18 begins to exceed the pressure within the lower chamber 19, an opening-closing member 72 opens the through flow path 28 by the biasing force of a spring 71 so that the equal pressure state within the upper and lower chambers 18, 19 is maintained. Thus, when the piston 20 is automatically raised, the air compressed within the upper chamber 18 is returned to the lower chamber 19 through the through flow path 28, and the piston 20 can be reliably returned until the uppermost position.

On the other hand, while the interior of the lower chamber 19 is compressed, the air pressure within the lower chamber 19 exceeds the biasing force of the spring 71, and pushes up the opening-closing member 72 so that the through flow path 28 is blocked. Thus, at a molding starting time and a molding final stage using a press, the through flow path 28 is blocked by the opening-closing member 72 and the air within the lower chamber 19 can be reliably compressed so that large reaction force F can be obtained.

Further, in such a construction, since no air is exhausted to the exterior of the cylinder 10, energy loss can be reduced.

Such a construction may be also applied to the piston 20 of the die cushion device externally having the switching device as in the third and fourth embodiment modes. In this case, it is possible to remove the third ports 436, 626 of the sleeves 431, 621, etc.

Figure 11:
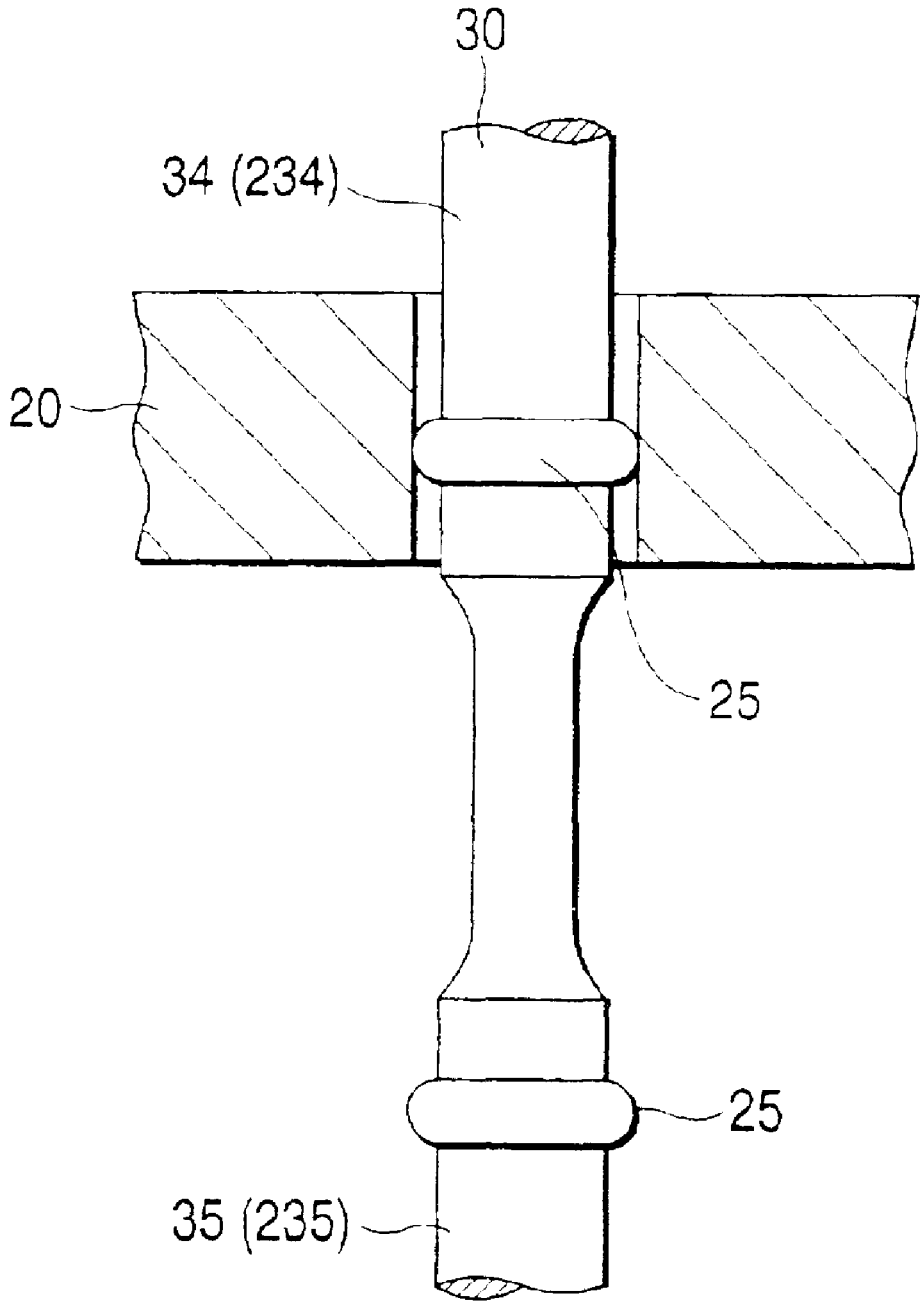
FIG. 11 is a sectional view showing another modified example of the invention.

In the first and second embodiment modes, the sealants 24, 224 are arranged within the communication holes 23, 223 of the pistons 20, 220. However, for example, as shown in FIG. 11, an annular sealant 25 maybe also arranged in each of the large diameter portions 34, 334 and the lower large diameter portions 35, 335 of the spool 30.

Further, the die cushion devices 1 to 4 of the respective embodiment modes are constructed such that the reaction force F is increased at the starting time of molding using a press, and is reduced at the intermediate time of the molding, and is again increased at the final time of the molding. However, the reaction force F may be optionally changed during one stroke, and may be appropriately determined in the operation of the die cushion device. Accordingly, for example, the reaction force F may be reduced at the starting and final times of the molding, and large reaction force F may be generated at the intermediate time of the molding. Further, large reaction force F may be generated at the molding starting time, and, thereafter, small reaction force F may be generated until the molding final time. Conversely, small reaction force F may be generated at the molding starting time, and, thereafter, large reaction force F may be generated until the molding final time. Such cases are also included in the invention.

In the second embodiment mode, the die cushion device is set to a multistage type by arranging the switching portions 33, 233 above and below one spool 30, but is not limited to this type. For example, a die cushion device at plural stages may be also realized by arranging plural spools extending through the piston within one cylinder, and arranging switching portions in the respective spools, and shifting positions of the respective switching portions from each other.

Shapes of the rotor 437 and the spool 628 used in the third and fourth embodiment modes may be devised and rotors 437 and spools 628 may be also added in number to realize the die cushion device of the multistage type.

What is claimed is:

1. A cushioning device for use in a press, which comprises:

a die cushion pad;

a cylinder;

a piston arranged in the cylinder;

a rod connecting the die cushion pad and piston and sliding within the cylinder;

first and second chambers arranged within said cylinder and separated by said piston sliding within said cylinder, said second chamber containing a compressible fluid; and control means for controlling inflow and outflow of a fluid between said first and second chambers in association with a stroke of said piston, said control means including a communication hole arranged in the piston and a valve arranged within said communication hole, said valve being separate from said rod, said valve including upper and lower portions with a first larger thickness that prohibit passage of fluid between the upper and lower chambers, said valve further including a middle portion with a second smaller thickness that permits passage of fluid between the upper and lower chambers, said middle portion being arranged between said upper and lower portions;

wherein; said communication hole and said valve work together so that during a downward motion of the piston from an upper location of the piston; a first cushioning force is firstly provided, a second cushioning force is secondly provided that is smaller than the first cushioning force, and a third cushioning force is thirdly provided that is larger than the second cushioning force.

2. A cushioning device according to claim 1, further comprising pressure exhaust means for exhausting a fluid pressure within said first chamber on said rod side.

3. A cushioning device according to claim 2, wherein a plurality of said control means are arranged.

4. A cushioning device according to claim 1, further comprising a bypass flow path arranged outside the cylinder connecting the first and second chambers, the bypass flow valve containing a check valve that is opened when pressure in the first chamber is equal to or greater than pressure in the second chamber, thereby permitting fluid flow from the first chamber to the second chamber.

5. A cushioning device according to claim 1, wherein a plurality of said control means are arranged in series.

6. A cushioning device according to claim 1, wherein said control means includes a spool extending through said piston, said spool cooperating with said valve for controlling inflow and outflow of a fluid between said first and second chambers in association with said stroke of said piston.

7. A cushioning device according to claim 1, wherein said rod is a solid rod.

8. A cushioning device according to claim 7, wherein a plurality of said control means are arranged.

9. A cushioning device for use in a press, which comprises:

a die cushion pad;

a cylinder;

a piston arranged in the cylinder;

a rod connecting the die cushion pad and piston and sliding within the cylinder;

first and second chambers arranged within said cylinder and separated by said piston sliding within said cylinder; and control means for controlling inflow and outflow of a fluid between said first and second chambers in association with a stroke of said piston, said control means including a switching device arranged outside said cylinder; said switching device including a roller, a roller guide member, and a spool valve; said spool valve including a spring and a spool biased by said spring; said roller guide member traveling in the same direction and together with said piston, and said roller following movement of said roller guide member and operating said switching device corresponding to travel distance of said roller guide member; so that during a downward motion of the piston from an upper location of the piston; a first cushioning force is firstly provided, a second cushioning force is secondly provided that is smaller than the first cushioning force, and a third cushioning force is thirdly provided that is larger than the second cushioning force.

10. A cushioning device according to claim 9, further comprising pressure exhaust means for exhausting a fluid pressure within said first chamber on said rod side.

11. A cushioning device according to claim 10, wherein a plurality of said control means are arranged.

12. A cushioning device according to claim 9, wherein said rod is a solid rod.

13. A cushioning device according to claim 12, wherein a plurality of said control means are arranged.

14. A cushioning device according to claim 9, wherein a plurality of said control means are arranged.

* * * * *